US007150519B2

(12) United States Patent
Kono et al.

(10) Patent No.: US 7,150,519 B2
(45) Date of Patent: Dec. 19, 2006

(54) INK JET RECORDING APPARATUS

(75) Inventors: Takeshi Kono, Kanagawa (JP); Mitsuru Kurata, Kanagawa (JP); Akihiro Yamanaka, Kanagawa (JP); Takeaki Shima, Kanagawa (JP); Tetsuto Kageyama, Kanagawa (JP); Itaru Watanabe, Kanagawa (JP); Hiroki Tajima, Kanagawa (JP); Toshihiro Sasaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 10/078,457

(22) Filed: Feb. 21, 2002

(65) Prior Publication Data

US 2005/0151800 A1 Jul. 14, 2005

(30) Foreign Application Priority Data

Feb. 23, 2001 (JP) ..... 2001-048667
Feb. 23, 2001 (JP) ..... 2001-048671

(51) Int. Cl.
*B41J 2/175* (2006.01)
*B41J 2/165* (2006.01)

(52) U.S. Cl. ..... 347/85; 347/30; 347/87

(58) Field of Classification Search ..... 347/7, 347/22, 30, 85–87, 20, 24, 47, 65, 29
See application file for complete search history.

(56) References Cited

U.S. PATENT DOCUMENTS 4,577,203 A * 3/1986 Kawamura ..... 347/30
5,023,625 A * 6/1991 Bares et al. ..... 347/48
5,640,181 A 6/1997 Uchida et al. ..... 347/30
5,742,314 A * 4/1998 Hayes ..... 347/93
5,880,748 A * 3/1999 Childers et al. ..... 347/6
5,992,985 A * 11/1999 Young et al. ..... 347/85
6,302,516 B1 * 10/2001 Brooks et al. ..... 347/35
6,517,189 B1 * 2/2003 Ogawa et al. ..... 347/35
6,578,948 B1 * 6/2003 Shima ..... 347/29

FOREIGN PATENT DOCUMENTS

| | | |
|---|---|---|
| EP | 0 609 863 | 8/1994 |
| EP | 0 803 364 | 10/1997 |
| EP | 1 057 644 | 12/2000 |
| EP | 1 231 062 | 8/2002 |
| EP | 1 232 870 | 8/2002 |

(Continued)

*Primary Examiner*—Stephen Meier
*Assistant Examiner*—Geoffrey S. Mruk
(74) *Attorney, Agent, or Firm*—Fitzpatrick, Cella, Harper & Scinto

(57) ABSTRACT

An ink jet recording apparatus comprises a recording head including a discharge port for discharging ink, a first liquid chamber at the upstream side in the direction of ink flow toward the discharge port, and a second liquid chamber at the downstream side, an ink tank for containing ink to be supplied to the recording head, an ink supply tube for causing the ink tank to communicate with the recording head, a shut-off valve provided in the ink supply tube and opening or closing the ink supply tube, a cap for covering the discharge port; and a suction pump for forcedly discharging the ink in the recording head from the discharge port when the cap covers the discharge port. The shut-off valve is opened when the first and second liquid chambers are reduced to respectively desired pressures by the suction pump in a state where the cap covers the discharge port and the shut-off valve is closed, whereby the ink in the ink tank is supplied through the ink supply tube to the first and second liquid chambers.

2 Claims, 7 Drawing Sheets

FOREIGN PATENT DOCUMENTS

| | | |
|---|---|---|
| JP | 11-138856 | 5/1999 |
| JP | 2929804 | 5/1999 |

* cited by examiner

INK JET RECORDING APPARATUS

BACKGROUND OF THE INVENTION

1. Field of the Invention

The present invention relates to an ink jet recording apparatus.

2. Related Background Art

The recording apparatus for recording on a recording medium conventionally employs various recording methods such as the wire dot method, thermal recording method, thermal transfer recording method, ink jet method, etc. Among these methods, the ink jet recording method for forming a record on a recording medium by discharging small ink droplets from a discharge port (nozzle) is widely employed in recent years because it is a non-impact recording method with various advantages such as scarce noise generation at recording, and capability of executing high-density and high-speed recording on various recording media.

An ink jet recording apparatus is generally provided with an ink jet recording head, means for conveying the recording medium, and control means for controlling these components. The method for generating energy for ink discharge from the nozzle of the ink jet recording head can be, for example, pressurization of ink with an electromechanical converting element such as a piezo element, bubble generation by irradiation with electromagnetic waves for example from a laser, bubble generation by liquid heating with an electrothermal converting element such as a heat generating resistor, etc. Among these, a method for discharging ink droplets by thermal energy (bubble jet method) can achieve recording of high resolution because the energy generating means can be arranged at a high density. Particularly, an ink jet recording head utilizing an electrothermal converting element as the energy generating means can be made compact and provides advantages of easily achieving high-density configuration and low manufacturing cost, utilizing the IC technology and the microfabrication technology showing remarkable progress and improvement in reliability in the semiconductor area.

The ink jet recording apparatus representing the background technology and shown in FIG. 6 is a recording apparatus of serial type, in which the recording head is mounted on a carriage (not shown) and the recording operation is executed by the movement of such carriage, employing so-called tube supply system in which the recording head is connected with a main tank through a tube. Such ink jet recording apparatus is provided with a main tank (ink tank) 104 for containing ink, a recording head 101 for discharging ink droplets by thermal energy, an ink supply unit 105 and an ink supply tube 106 for ink supply from the main tank 104 to the recording head 101, an air discharge tube 110*a*, a shut-off valve 110*b* and an air discharge pump 110*c* for opening the recording head 101 to the air, and a recovery unit 107 for a recovery process for the recording head 101.

At first there will be explained the schematic configuration of the recording head 101. A discharge nozzle 101*g* in the recording head 101 is composed of a fine hole. The nozzle 101*g* is not provided with a valve mechanism, and ink leakage from the nozzle 101*g* or air intrusion therein is prevented by maintaining the interior of the nozzle at a negative pressure, thereby forming an ink meniscus at the front end of the nozzle. More specifically, since the nozzle 101*g* is open to air and the aperture of the nozzle 101*g* is positioned downwards, the interior thereof has to be maintained at a negative pressure in order to prevent ink leakage therefrom. On the other hand, an excessively large negative pressure causes air to enter the nozzle 101*g*, thereby disabling the ink discharging operation. Therefore, in order to maintain the interior of the recording head 101 at an appropriate negative pressure state, the recording head 101 is so positioned that the aperture of the nozzle 101*g* is higher by a height H than the ink liquid level in an ink chamber 105*f* (to be explained later), thereby maintaining the interior of the recording head 101 at a negative pressure corresponding to a water head of a height H. Thus, the nozzle 101*g* is maintained in a state filled with ink by forming a meniscus at the aperture.

The ink discharge is executed by pushing out the ink in the nozzle 101*g* by film boiling energy generated by an unrepresented heater (heat generating resistor) positioned in the vicinity of the nozzle 101*g*. After the ink discharge, the ink is replenished into the nozzle 101*g* by the capillary force thereof and is thus sucked up from time to time from the main tank 104 through the ink supply tube 106. Such ink discharge and ink supply (refilling) are repeated.

In the interior of the recording head 101, there are provided a filter 101*c* of fine mesh structure for preventing clogging of the fine hole of the nozzle 101*g* with particles, a flow path 101*f* finely branched for connecting the filter 101*c* with the nozzles 101*g*, and a sub tank 101*b* for containing a predetermined amount of ink at the upstream side of the filter 101*c*, whereby the ink flowing in from the ink supply tube 106 is supplied to the nozzle 101*g*.

In the following there will be explained the schematic configuration of the main ink 104 and the ink supply unit 105. The configuration is substantially same as that disclosed, for example, in the Japanese Registered Patent No. 2929804, wherein a hollow ink supply needle 105*a* and a hollow air introducing needle 105*b* fixed to the ink supply unit 105 penetrate a connector 104*b* at the bottom of the main tank 104 and enter the main tank 104. Inside the ink supply unit 105, there is provided an ink tank chamber 105*f* which is open to the air by an air communicating aperture 105*g*, and the needles 105*a*, 105*b* are positioned therein so as to be immersed, with different lower end heights in the ink. The bottom of the ink chamber 105*f* communicates with the ink supply tube 106, and, along with the ink consumption, the ink in the ink chamber 105*f* decreases whereby the lower end of the air introducing needle 105*b* is separated from the ink and is exposed to the air. Thus, the air introduced from the lower end of the air introducing needle 105*b* into the main tank 104 and the ink in the main tank 104 flows to the ink chamber 105*f*. When the liquid level in the ink chamber 105*f* rises by such ink flow, the lower end of the air introducing needle 105*f* is again immersed in the ink, thereby terminating the air introduction into the main tank 104 and the ink flow into the ink chamber 105*f*. In this manner the ink in the ink tank 104 is gradually taken out.

In the lower part of the main tank 104, an electrode 104*e* is provided in contact with the ink, thus in electric conduction with a contact 104*j* provided in the ink supply unit 105. Between the contact 105*j* and the air introducing needle 105*b*, there is connected a detection circuit including a detector 105*h* for measuring the electric resistance of the ink. The presence or absence of the ink can be detected by measuring the electric resistance of the ink by such detection circuit.

In the following there will be explained the air discharge tube 110*a*, the shut-off valve 110*b* and the air discharge pump 110*c*. In the sub tank 101*b* of the recording head 101, there may be accumulated air that permeates through a resinous material, for example, of the ink supply tube 106 or is dissolved in the ink. Therefore, thus accumulated excessive air is periodically discharged, together with the ink, from a lateral portion of the sub tank 101*b*, by suction with the air discharge tube 110*a* and the air discharge pump 110*c*. Upon completion of the air discharge, the air discharge path is closed by the shut-off valve 110*b*.

In the following there will be explained the recovery unit 107. In case the discharge nozzle 101*g* is clogged with viscosified ink or with excessive bubbles generated at the ink discharge, the recovery unit 107 is used for eliminating such viscosified ink or bubbles by contacting a suction cap 107*a* with the recording head 101, and sucking the ink, together with the viscosified ink and bubbles, strongly from the nozzle 101*g* by a suction pump thereby recovering the function of the recording head 101.

In the ink jet recording apparatus of the aforementioned background technology, there is known a phenomenon, in case of ink discharge for recording by bubble generation of the air dissolved in the ink by heat generation in a heater corresponding to the nozzle 101*g*, that bubbles are gradually accumulated in the flow path 101*f* by fission of the generated bubbles and accumulation thereof in the flow path 101*f* under the filter 101*c* or by gathering of fine bubbles present in the ink by a temperature increase around the heater.

In the configuration of the aforementioned background technology, since the flow path 101*f* is narrowly formed, the ink flow tends to become stagnant therein so that the movement of the bubble is retarded. The strong suction by the recovery unit 107 increases the ink flow speed whereby the ink and bubbles in the flow path 101*f* can be discharged, but, if the bubble grows to a size completely interrupting the flow path 101*f*, the ink supply to the nozzle 101*g* is hindered, so that the suction by the recovery unit 107 has to be executed frequently to discharge the bubble before it grows excessively. Therefore, the amount of ink wasted at each suction inevitably increases.

On the other hand, if the flow path 101*f* is formed thicker so as not to be interrupted or clogged by the bubble, the bubble rises to the upper part of the flow path 101*f* and the suction, even if executed strongly, from the nozzle 101*g* by the recovery unit 107 can only suck out the ink and cannot discharge the bubble by suction. Also, since the filter 101*c* has a fine mesh structure, the ink entering each pore of the mesh forms a meniscus therein which cannot be penetrated by the air. Thus the bubbles cannot escape to the sub tank 101*b* but accumulate in the upper part of the flow path 101*f*. Such bubble accumulation increases the volume occupied by the air in the flow path 101*f*, thus leading to an ink amount decrease therein, which leads to the exposure, to the air, of the ink supply aperture at the upper face of the nozzle 101*g*, eventually resulting in a situation in which the ink supply thereto is disabled.

Particularly in recent years, as a result of increase in the number of nozzles and in the driving rate (ink discharge at a higher drive frequency) in the recording head, the bubble generation at the printing operation is increasing in general. The ink consumption per unit time becomes therefore larger, so that the fine flow path as employed in the background technology leads to a larger pressure loss, thus resulting in a discharge failure.

SUMMARY OF THE INVENTION

An object of the present invention is to provide an ink jet recording apparatus capable of preventing a significant reduction in the ink amount in the recording head or the interruption of the flow path in the recording head by the bubble, and also of reducing the wasted ink discharge amount not contributing to the recording, in the recovery process.

Another object of the present invention is to provide an ink jet recording apparatus comprising a recording head including a discharge port for discharging ink, a first liquid chamber provided at the upstream side in the direction of ink flow toward the discharge port and a second liquid chamber at the downstream side, an ink tank for containing the ink to be supplied to the recording head, an ink supply tube connecting the ink tank and the recording head, a shut-off valve provided in the ink supply tube for opening or closing the ink supply tube, a cap for covering the discharge port, and a suction pump for forcedly discharging the ink in the recording head from the discharge port when it is covered by the cap, wherein the shut-off valve is opened after the first and second liquid chambers are reduced to respectively desired pressures by the suction pump in a state where the shut-off valve is closed and the discharge port is covered by the cap, whereby the ink in the ink tank is supplied through the ink supply tube to the first and second liquid chambers.

In this manner the two divided liquid chambers can be filled with the ink and can therefore contain the ink of appropriate amounts. Thus, even in case of employing a wider liquid path in the recording head, it is possible to extract the air from the liquid chambers and to replenish ink therein. It is also rendered possible to prevent prolonged ink deficiency in both liquid chambers, so that the frequency of the recovery operation can be reduced to decrease the wasted ink amount. The ink amount can be further saved because there is only required a single filling process even in case the ink filling is required in both liquid chambers.

Another feature of the present invention lies in that the volume V1 of the first liquid chamber is so selected as to substantially satisfy a relation V1=S1/|p1|, wherein p1 (atm) is the reduced pressure in the first liquid chamber at the suction operation (relative value from the atmospheric pressure), and S1 is the ink amount to be present in the first liquid chamber. Still another feature of the present invention lies in that the volume V2 of the second liquid chamber is so selected as to substantially satisfy a relation V2=S2/|p2|, wherein p2 (atm) is the reduced pressure in the second liquid chamber at the suction operation (relative value from the atmospheric pressure), and S2 is the ink amount to be present in the second liquid chamber. Thus the ink can be filled in such a manner that the liquid chambers respectively contain ink of appropriate amounts, utilizing the law PV=constant.

Between the first and second liquid chambers, there is preferably provided a filter for separating the two. The filter may have a mesh structure having a plurality of pores. It is preferable to set the parameters so as to satisfy a relation p1=p2−pm wherein pm is the pressure of the ink meniscus strength in each pore of the filter, p1 (atm) (relative value from the atmospheric pressure) is the reduced pressure in the first liquid chamber at the suction operation, and p2 (atm) (relative value from the atmospheric pressure) is the reduced pressure in the second liquid chamber at the suction operation, also to set the volume V1 of the first liquid chamber so as to satisfy a relation V1=S1/|p1| wherein S1 is the ink amount to be present in the first liquid chamber, and to set the volume V2 of the second liquid chamber so as to satisfy a relation V2=S2/|p2| wherein S2 is the ink amount to be present in the second liquid chamber.

More specifically, as the ink penetrates the filter of fine mesh structure, a fine meniscus is formed in each pore of the filter, whereby the ink can easily pass through the filter but the air cannot easily pass. As the mesh becomes finer, the meniscus strength becomes larger to reduce the permeability to the air, whereby a pressure pm is required for air permeation. This pressure pm can be determined experimentally. In case of suction from the nozzle by the recovery unit, the pressure p2 in the second liquid chamber, involving air permeation of the sub tank through the filter, becomes lower than p1 in the first liquid chamber by the pressure pm corresponding to the meniscus strength. The parameters can be easily determined by utilizing this relationship in determining the volumes of the liquid chambers.

The ink amounts to be present in the first and second liquid chambers are preferably larger than the air amounts to be accumulated in the first and second liquid chambers, and also larger than the sum of the air amounts to be respectively accumulated in the first and second liquid chambers and the minimum ink amounts respectively required for securing the stable performance in the first and second liquid chambers.

By filling the ink in such a manner that the first liquid chamber contains an ink amount larger than the minimum ink amount (required to immerse the filter securely in the ink) and larger than the sum of the air amount accumulated therein in a predetermined period (a prolonged period such as a month) and that the second liquid chamber contains an ink amount larger than the minimum ink amount (required to immerse the nozzle securely in the ink) and larger than the sum of the air amount accumulated therein in the same predetermined period, the filling operation can be executed only one in such predetermined period, whereby the amount of the discharged ink can be saved.

Besides, there is adopted a configuration in which the cap and the shut-off valve are driven in linkage by common drive means to provide an effect that the valve does not require the drive source other than that for the suction means, whereby the cost of the ink jet recording apparatus can be reduced. Also it is no longer necessary to provide the separate drive means for the valve and the suction means, so that the drive means can be controlled by a simple sequence.

Furthermore, in case the drive means is capable of moving the cap means for covering the ink discharge face of the recording head in a capping position in contact with the ink discharge face and in a retracted position separated from the ink discharge face, a valve member constituting the valve can be so constructed as to execute a reciprocating motion whereby the motion of the cap means can be made similar to that of the valve, so that the drive means for moving the cap means can be reasonably utilized also as the drive means for the valve.

Furthermore, by adopting a configuration in which a first cam for moving the cap means and a second cam for opening or closing the valve are rotated on a common shaft by a driving motor, there is provided an advantage that the sequential control of the suction means and the valve can be achieved by a simple control of rotating such motor in a single direction by a predetermined angle at a time.

Furthermore, by constructing the mounting portion of the ink tank, the valve and the connecting tube for connecting the valve to the recording head as a supply unit separate from the suction means and detachable from the main body of the recording apparatus without disassembling the flow path, and by adopting a configuration in which the supply unit is positioned adjacent to the suction means and the valve is driven, either through a cam or a link, by the drive means for driving the suction means, it is rendered possible to avoid ink leakage at the disassembling of the components at the repair of the recording apparatus, and to ensure reliability against ink leakage, etc., in the connecting portion of the flow paths in the ink supply path.

DETAILED DESCRIPTION OF THE PREFERRED EMBODIMENTS

Now the present invention will be clarified in detail by embodiments thereof with reference to the accompanying drawings.

Figure 1:
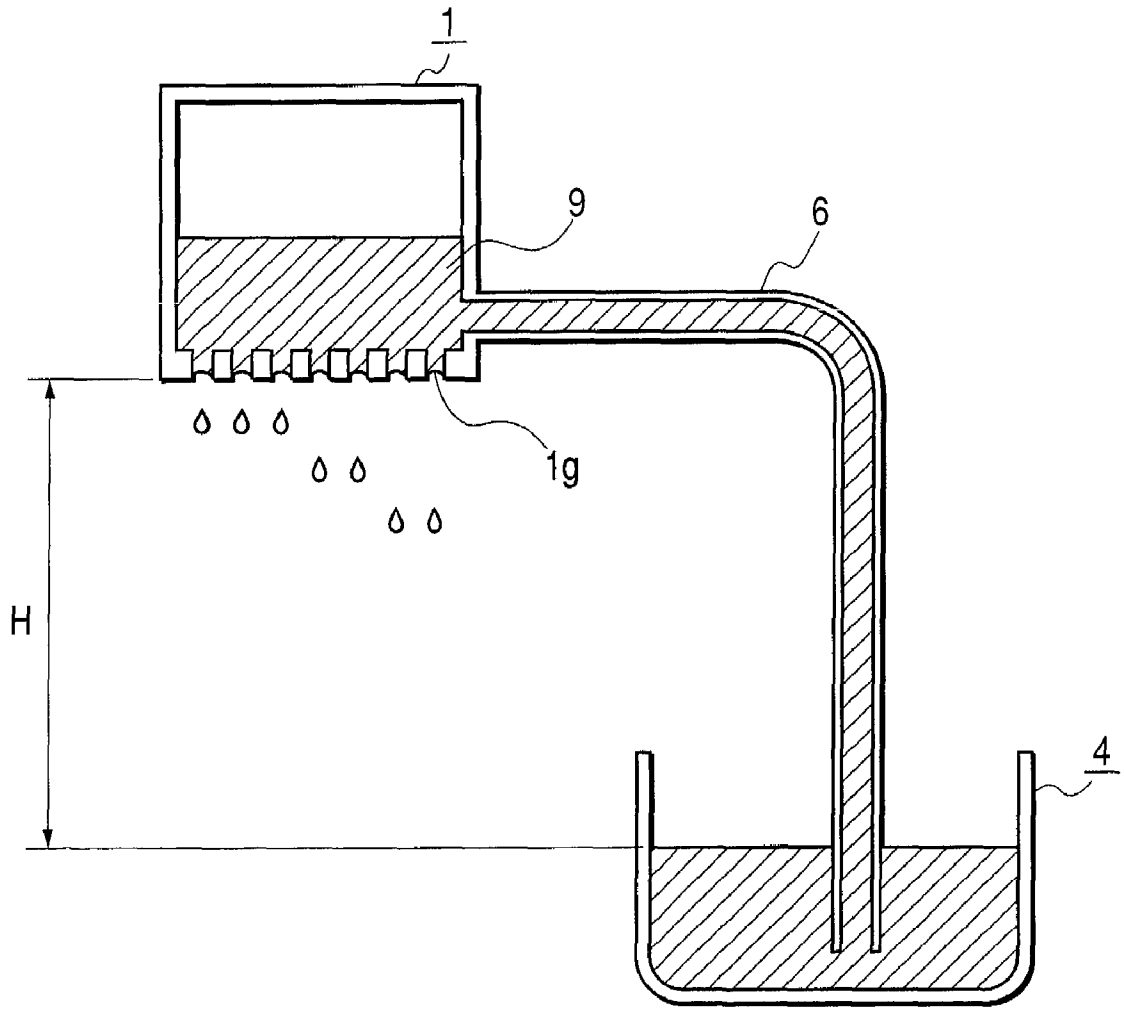
FIG. 1 is a perspective view showing the schematic configuration of an ink jet recording apparatus constituting an embodiment of the present invention.

FIG. 1 is a perspective view showing the schematic configuration of an ink jet recording apparatus constituting an embodiment of the present invention. The ink jet recording apparatus of the present embodiment is a recording apparatus of serial type for forming a character, a symbol, an image etc. by repeating the reciprocating motion (main scanning) of a recording head 201 and the conveying (sub scanning) of a recording sheet S such as ordinary recording paper, special paper or an OHP film and selectively discharging ink from the recording head 201 in synchronization with these motions for deposition on the recording sheet S.

Figure 2:
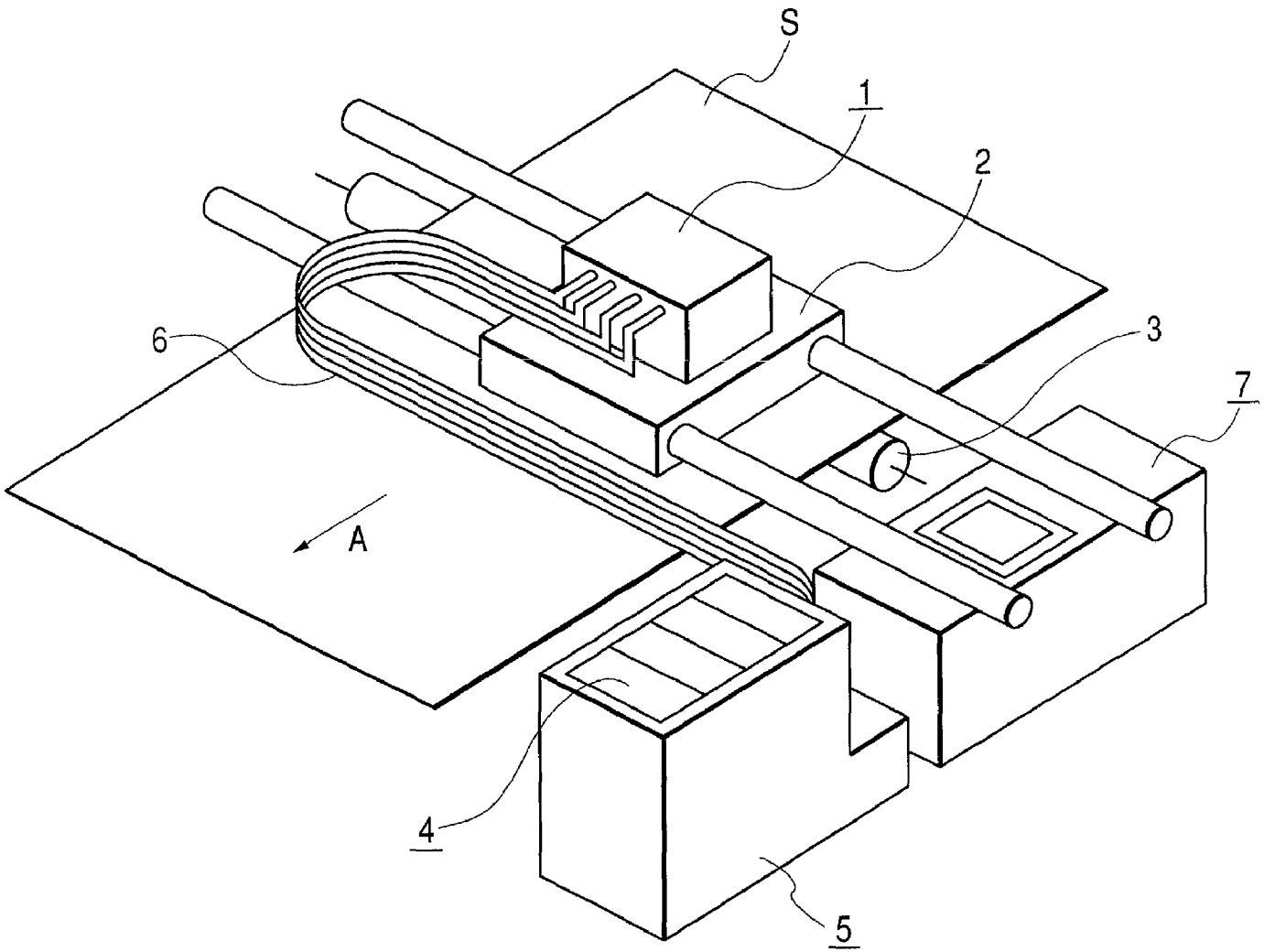
FIG. 2 is a view showing the principle of ink supply in the ink jet recording apparatus shown in FIG. 1.

Referring to FIGS. 1 and 2, the recording head 1 is detachably mounted on a carriage 2 slidably supported by two guide rails and reciprocated along the guide rails by drive means such as an unrepresented motor. The recording sheet S is conveyed in a direction crossing the moving direction of the carriage 2 (for example in a perpendicular direction A) by a conveying roller 3 so as to be opposed to the ink discharge face of the recording head 1 and to maintain a constant distance to the ink discharge face.

Figure 7:
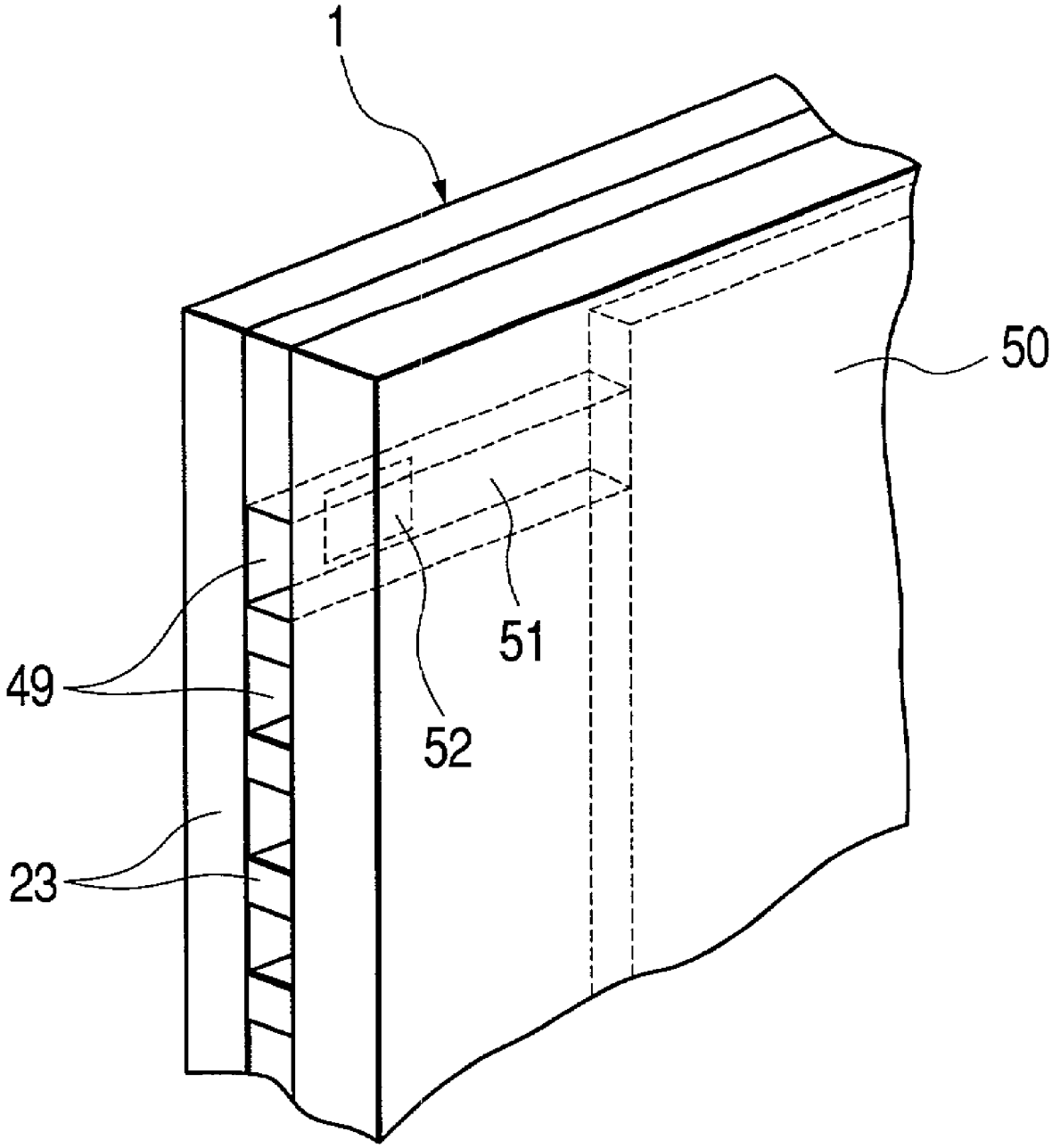
FIG. 7 is a partial perspective view schematically showing the configuration of an ink discharge portion of the recording head.

FIG. 7 is a partial perspective view schematically showing the structure of an ink discharge portion (an array of discharge ports) of the recording head 1. Referring to FIG. 7, a discharge port face 23, opposed to the recording material such as recording paper with a predetermined gap thereto (for example, about 0.2 to 0.3 mm), is provided with plural discharge ports 49 formed at a predetermined pitch, and an electrothermal converting member (for example, heat generating resistor) 52 for generating ink discharging energy is provided along the wall of each liquid path 51 connecting a common liquid chamber 50 and each discharge port 49. The recording head 1 is supported and guided in such positional relationship that the discharge ports 49 are arranged in a direction crossing the main scanning direction (moving direction of the carriage). In the recording head 1 thus constructed, the electrothermal converting member 52 is selectively driven by an image signal or a discharge signal (by the application of a pulse signal) to induce film boiling of the ink in the liquid path 51, thereby discharging the ink from the discharge port 49 by the generated pressure.

The recording head 1 is provided with plural nozzle arrays for discharging inks of respectively different colors (for example, black, cyan, magenta and yellow). Such nozzle arrays are substantially perpendicular to the main scanning direction. Corresponding to the ink colors discharged from the recording head 1, plural independent main tanks (ink tanks) 4 are detachably mounted on the ink supply unit 5. The ink supply unit 5 and the recording head 1 are connected by plural ink supply tubes 6 respectively corresponding to the ink colors, and the mounting of the main tanks 4 on the ink supply unit 5 enables to independently supply the nozzle arrays of the recording head 1 with the inks of respective colors contained in such main tanks 4.

In a non-recording area within the movable range of the recording head 1 but outside the passing range of the recording sheet S, there is provided a recovery unit 7 so as to be opposed to the ink discharge face of the recording head 1. The recovery unit 7 serves to suck ink or bubbles forcedly from the discharge nozzles of the recording head 1, thereby cleaning the nozzles.

In the following there will be briefly explained, with reference to FIG. 2, the basic principle of ink supply in the above-described ink jet recording apparatus.

The recording head 1 and the main tank 4 are connected by the ink supply tube 6 to constitute the ink supply path, which is filled with ink 9. The recording head 1 is so positioned that the position of the nozzle 1*g* is higher than the liquid level of the main tank 4 by a height H whereby the interior of the recording head 1 is maintained at a negative pressure corresponding to the water head of the height H. Such negative pressure maintains an ink meniscus formed at the front end of the nozzle 1*g* of the recording head 1. In this manner there is prevented ink leakage from the nozzle 1*g* and air intrusion therein. When ink is discharged from the nozzle 1*g*, the ink amount in the recording head 1 decreases to temporarily increase the negative pressure thereby retracting the meniscus, but the ink is then filled in the nozzle 1*g* by the capillary force thereof, whereupon the ink 9 is sucked up from the main tank 4 through the ink supply tube 6 to restore the pressure in the recording head 1, thereby stabilizing the meniscus at the front end of the nozzle 1*g*. Such ink discharge and ink supply (refilling) are repeated. The ink jet recording apparatus of the present embodiment is based on such basic principle.

Figure 3:
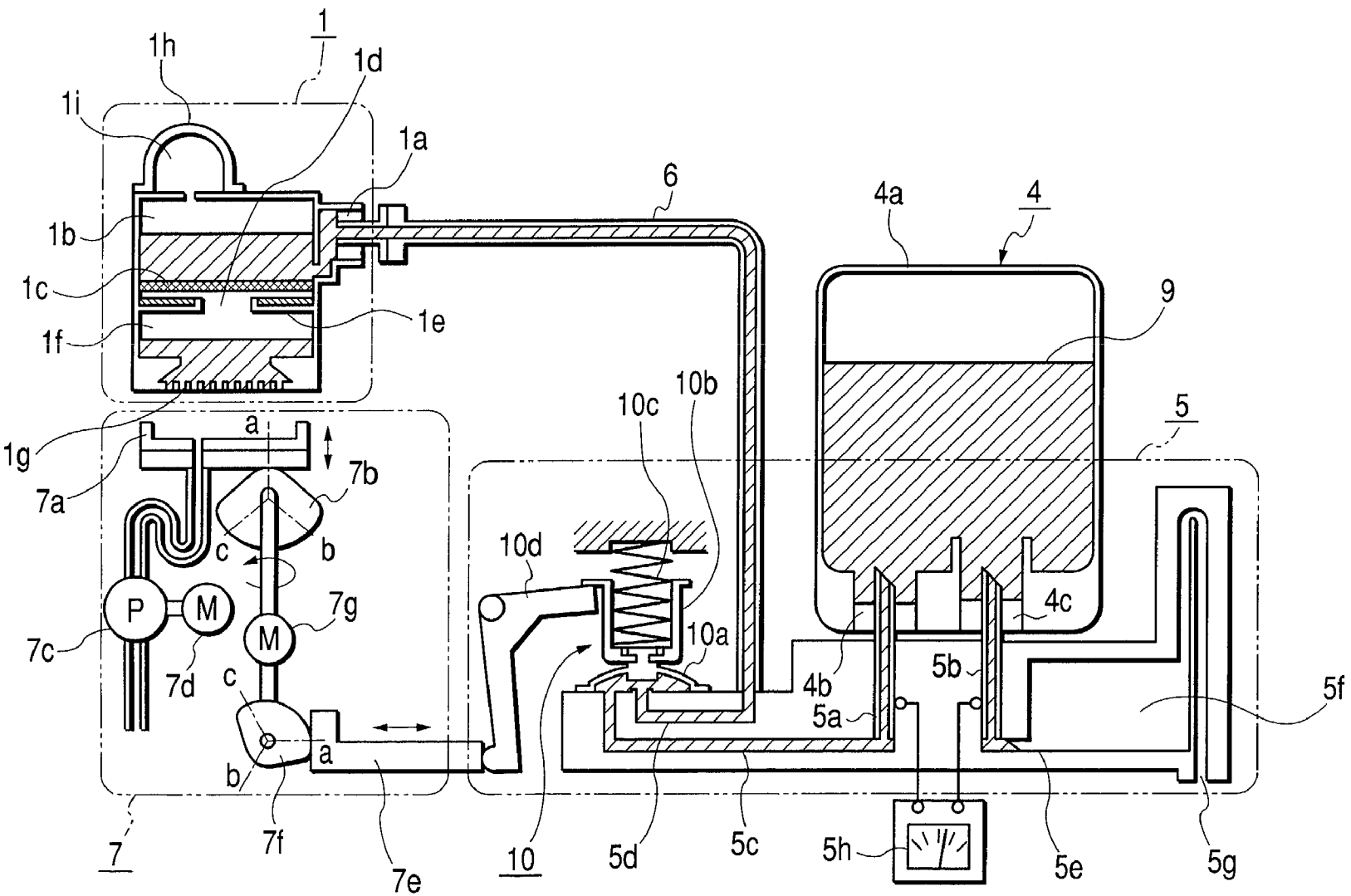
FIG. 3 is a view showing an ink supply path for a color in the ink jet recording apparatus shown in FIG. 1.

In the following there will be explained, with reference to FIG. 3, the detailed configuration of the ink supply system of the present ink jet recording apparatus. FIG. 3 shows the ink supply path of the ink jet recording apparatus shown in FIG. 1, illustrating the path for one color only for the purpose of simplicity.

At first there will be given an explanation on the recording head 1. The ink is supplied to the recording head 1, from a connector insertion port 1*a* which is hermetically connected to a liquid connector provided at the front end of the ink supply tube 6. The connector insertion port 1*a* communicates with a sub tank (first liquid chamber) 1*b* formed in the upper part of the recording head 1. Below the sub tank 1*b* in the direction of gravity, there is formed a liquid chamber (second liquid chamber) 1*f* for direct supply of the ink to a nozzle portion having plural nozzles 1*g* arranged in parallel manner. The sub tank 1*b* and the liquid chamber 1*f* are separated by a filter 1*c*. At the boundary between the sub tank 1*b* and the liquid chamber 1*f* there is provided a partition portion 1*e* including an aperture 1*d*, and the filter 1*c* is placed on such partition portion 1*e*.

In the above-described configuration, the ink supplied from the connection insertion port 1*a* to the recording head 1 is supplied through the sub tank 1*b*, filter 1*c* and liquid chamber 1*f* to the nozzle 1*g*. The path from the connection insertion port 1*a* to the nozzle 1*g* is maintained in a state closed to the external air.

The upper face of the sub tank 1*b* is provided with an aperture which is covered by a dome-shaped elastic member lh. A space surrounded by the elastic member lh constitutes a pressure adjusting chamber 1*i*, of which volume changes according to the pressure in the sub tank 1*b* for adjusting the pressure therein, as will be explained later.

The nozzle 1*g* has a tubular structure of a cross-sectional width of about 20 μm and discharges ink by applying discharge energy to the ink in the nozzle 1*g*, and, after the ink discharge, the ink is filled in the nozzle 1*g* by the capillary force thereof. Normally the ink discharge is repeated with a frequency of 20 kHz or higher to achieve high-definition image formation at a high speed. In order to apply the discharge energy to the ink in the nozzle 1*g*, the recording head 1 is provided with energy generation means in each nozzle 1*g*. The present embodiment employs, as the energy generation means, a heat generating resistor element for heating the ink in the nozzle 1*g*. An instruction from a head control unit (not shown) for controlling the recording head 1 selectively drives the heat generating resistors to induce film boiling of the ink in the desired nozzles 1*g*, thereby discharging ink from the nozzles 1*g* utilizing the pressure of a bubbles generated by such film boiling.

Such nozzle 1*g* is arranged with the ink discharging front end thereof downwards, but is not provided with a valve mechanism for closing such front end, and the ink fills the nozzle 1*g* by forming a meniscus. For this purpose, the interior of the recording head 1, particularly that of the nozzle 1*g*, is maintained at a negative pressure. However, if the negative pressure is excessively small, the ink meniscus may be broken by the deposition of dusts or ink at the front end of the nozzle 1*g*, thereby resulting in ink leakage from the nozzle 1*g*. On the other hand, if the negative pressure is excessively large, the force retracting the ink into the nozzle 1*g* becomes larger than the energy given to the ink at the discharge, thereby resulting in a discharge failure. Therefore, the negative pressure in the nozzle 1*g* is maintained within a certain range somewhat lower than the atmospheric pressure. Such negative pressure, though dependent on the number and cross-section of the nozzles 1*g* and the performance of the heat generating resistor, is preferably within a range from −40 mmAq (about −0.0040 atm=−4.053 kPa) to −200 mmAq (about −0.0200 atm=−2.0265 kPa) (wherein the specific gravity of ink is assumed equal to that of water) according to the experimental results of the present inventors.

In the present embodiment, the ink supply system or unit 5 and the recording head 1 are connected by the ink supply tube 6 and the position of the recording head 1 relative to the ink supply unit 5 can be relatively freely selected, so that the recording head 1 is positioned higher than the ink supply unit 5 in order to maintain the interior of the recording head 1 at a negative pressure.

The filter 1*c* is provided in order to prevent leak of a substance that may clog the nozzle 1*g*, from the sub tank 1*b* to the liquid chamber 1*f*. The area of the filter 1*c* is so selected that the pressure loss on the ink does not exceed a certain tolerance value. The pressure loss becomes higher as the mesh of the filter 1*c* becomes finer or the ink flow rate becomes higher, and is inversely proportional to the area of the filter 1*c*. In the recent recording apparatuses of high speed with multiple nozzles and with small recorded dots, the pressure loss tends to become higher, thus requiring a large filter of a size of about 10×20 mm. Accordingly there are also required large spaces in the sub tank 1*b* at the upstream side of the filter 1*c* and in the liquid chamber 1*f* at the downstream side of the filter 1*c*. The upper surface of the filter 1*c* is in contact with the ink in the sub tank 1*b*, and such contact area with the ink constitutes the effective area of the filter 1*c*. The pressure loss in the filter 1*c* is dependent on the effective area thereof. In the present embodiment, the filter 1*c* is positioned horizontally in the operational state of the recording head 1, and the entire upper surface of the filter 1*c* is maintained in contact with the ink to maximize the effective area of the filter, thereby lowering the pressure loss.

The filter 1*c* has such a property that, when brought into contact with ink, each fine hole forms a meniscus of the ink by the capillary force, whereby the ink permeation is easy, but the air flow through the filter becomes difficult. As the fine hole becomes smaller, the meniscus strength becomes larger and the air flow becomes more difficult.

In such filter 1*c* as employed in the present embodiment, the pressure required for passing air is about 0.1 atm (10.1325 pKa: experimental value). Therefore, if air is present in the liquid chamber 201*f*, present in the downstream side of the filter 1*c* in the ink moving direction in the recording head 1, the air cannot pass the filter 1*c* by the floating force of the air itself, and the air in the liquid chamber 1*f* remains therein. The present embodiment utilizes this phenomenon in such a manner that the liquid chamber 1*f* is not completely filled with the ink but contains an air layer between the ink in the ink chamber 1*f* and the filter 1*c*, and the ink of a predetermined amount is contained in the liquid chamber 1*f* in such a manner that the air layer separates the ink in the liquid chamber 1*f* and the filter 1*c*.

Also if gas enters the nozzle 1*g* from the liquid chamber 1*f*, the nozzle 1*g* after ink discharge cannot achieve ink replenishment, thus inducing discharge failure. Consequently the interior of the nozzle 1*g* has to be always filled with the ink.

The pressure adjusting chamber 1*i* reduces its volume as the internal negative pressure increases, and can be composed, as in the present embodiment, of an elastic member 1*h* which is preferably composed of a rubber material or the like.

In the absence of the pressure adjusting chamber 1*i*, the pressure in the sub tank 1*b* is subjected directly to the resistance by the pressure loss when the ink goes through the main tank 4, ink supply unit 5 and ink supply tube 6. Therefore, in case of a so-called high-duty ink discharge operation, such as ink discharge from all the nozzles 1*g*, the ink amount supplied to the recording head 1 becomes deficient relative to the discharged ink amount, whereby the negative pressure increases rapidly. If the negative pressure of the nozzle 1*g* exceeds the aforementioned limit value of −200 mmAq (about −2.0265 kPa), the discharge becomes unstable and unsuitable for image formation.

In the recording apparatus of serial scan type as in the present embodiment, even in the image formation with a high duty ratio, the ink discharge is interrupted at the inversion of the drive of the carriage 2 (FIG. 1). The pressure adjusting chamber 1*i* performs a function, like a capacitor, of reducing the volume during the ink discharge to relax the increase in the negative pressure in the sub tank 1*b* and restoring the volume at the inversion of the movement of the carriage.

In the following there will be given an explanation on the ink supply unit 5 and the main tank 4.

The main tank 4 is constructed to be detachably mountable on the ink supply unit 5 and is provided, on the bottom portion thereof, with an ink supply aperture tightly closed with a rubber stopper 4*b* and an air introducing aperture tightly closed with a rubber stopper 4*c*. The main tank 4 is singly an air-tight container, and the ink 9 is contained in the main tank 4 in liquid state.

On the other hand, the ink supply unit 5 is provided with an ink supply needle 5*a* for extracting ink 9 from the main tank 4, and an air introducing needle 5*b* for introducing air into the main tank 4. The ink supply needle 5*a* and the air introducing needle 5*b* are both hollow needles and are positioned, with the front ends upwards, corresponding to the ink supply port and the air introducing port of the main tank 4. When the main tank 4 is mounted on the ink supply unit 5, the ink supply needle 5*a* and the air introducing needle 5*b* respectively penetrate the rubber stoppers 4*b*, 4*c*, thus entering the interior of the main tank 4.

The ink supply needle 5*a* is connected, through a liquid path 5*c*, a shut-off valve 10 and a liquid path 5*d*, to the ink supply tube 6. The air introducing needle 5*b* is connected, through a liquid path 5*e*, a buffer chamber 5*f* and an air communicating aperture 5*g*, to the external air. The ink supply needle 5*a* and the air introducing needle 5*b* in the present embodiment are composed of thick needles of an internal diameter of 1.6 mm.

The shut-off valve 10 is provided with a rubber diaphragm 10*a* which is displaced to open or close the connection between the two liquid paths 5*c*, 5*d*. On the upper surface of the diaphragm 10*a*, there is mounted a tubular spring holder 10*b* containing therein a compression spring 10*c* which serves to press the diaphragm 10*a* thereby closing the connection between the liquid paths 5*c*, 5*d*. The spring holder 10*b* is provided with a flange, engaging with a lever 10*d* to be operated by a link 7*e* of the recovery unit 7 (to be explained later). By activating the lever 10*d* to lift the spring holder 10*b* against the spring force of the compression spring 10*c*, the connection between the liquid paths 5*c*, 5*d* is opened. The shut-off valve 10 is opened during the ink discharge from the recording head 1, but is closed during a stand-by state or in a non-operated state, and is opened and closed in synchronization with the recovery unit 7 during an ink filling operation (to be explained later).

The above-described configuration of the ink supply unit 5 is provided for each main tank 4, namely for each ink color, except for the lever 10*d*. The lever 10*d* is provided common to all colors and simultaneously opens or closes the shut-off valves 10 for all the colors.

In the above-described configuration, when the ink is consumed in the recording head 1, the resulting negative pressure causes the ink to be from time to time supplied from the main tank 4 to the recording head 1 through the ink supply unit 5 and the ink supply tube 6. At this operation, air of a same amount as that of the supplied ink from the main tank 4 is introduced into the main tank 4 from the air communicating aperture 5*g* through the buffer chamber 5*f* and the air introducing needle 5*b*.

The buffer chamber 5*f* provides a space for temporarily holding the ink flowing out of the main tank 4 by the inflation of gas in the main tank 4, and the lower end of the air introducing needle 5*b* is positioned at the bottom of the buffer chamber 5*f*. In case the air in the main tank 4 inflates by an increase in the ambient temperature or a decrease in the external pressure during a stand-by state or a pause of the ink jet recording apparatus, since the shut-off valve 10 is closed, the ink in the main tank 4 flows out to the buffer chamber 5*f* through the air introducing needle 5*b* and the liquid path 5*e*. On the other hand, as the air in the main tank 4 contracts, for example, by a decrease in the ambient temperature, the ink flowing out in the buffer chamber 5*f* returns to the main tank 4. Also in case the recording head discharges ink while the ink is present in the buffer chamber 5*f*, at first the ink in the buffer chamber 5*f* returns to the main tank 4 and the air is introduced into the main tank 4 after the ink in the buffer chamber 5*f* is depleted.

The volume Vb of the buffer chamber 205*f* is so selected as to satisfy the environmental use condition of the product. For example, for a product to be used within a temperature range of 5° C. (278° K) to 35° C. (308° K), and for a main tank 4 having a volume of 100 ml, the volume Vb is selected as 100×(308−278)/308=9.7 ml or larger.

Now there will be explained, with reference to FIGS. 4A to 4D, the basic water head of the main tank 4 and the behavior of air and ink in the liquid path of the ink supply unit 5 at the gas introduction into the main tank 4.

Figure 4A:
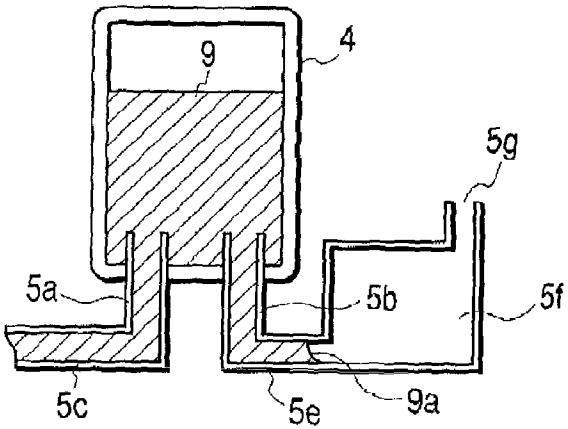
FIGS. 4A, 4B, 4C and 4D are views showing the behavior of air and ink in the liquid path of an ink supply unit, at the air introduction into a main tank in the ink supply path shown in FIG. 3.

FIG. 4A shows a normal state capable of ink supply from the main tank 4 to the recording head 1 (cf. FIG. 3). In this state, the interior of the main tank 4 is maintained air-tight except for the buffer chamber 5*f* and is maintained at a negative pressure relative to the atmospheric pressure, and the front end 9*a* of the ink remains in the liquid path 5*e*. The front end 9*a* of the ink is in contact with air and is therefore at the atmospheric pressure (=0 mmAq). The liquid path 5*c* in which the front end 9*a* of the ink is positioned and the liquid path 5*e* communicating with the ink supply tube 5 (cf. FIG. 3) are of a same height and mutually communicate only through the ink, so that the pressure of the liquid path 5*e* is also the atmospheric pressure. This pressure is determined only by the height relationship of the front end 9*a* of the ink and the liquid path 5*c* and is not influenced by the amount of ink 9 in the main tank 4.

Figure 4B:
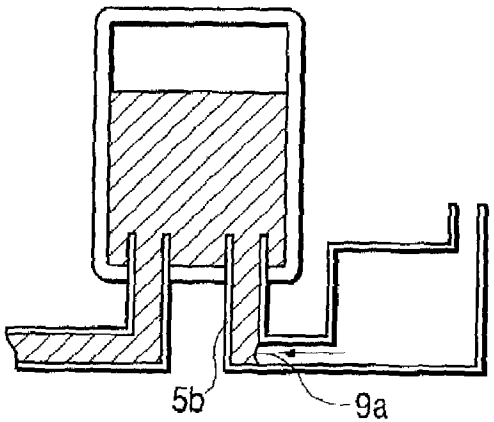
Figure 4C:
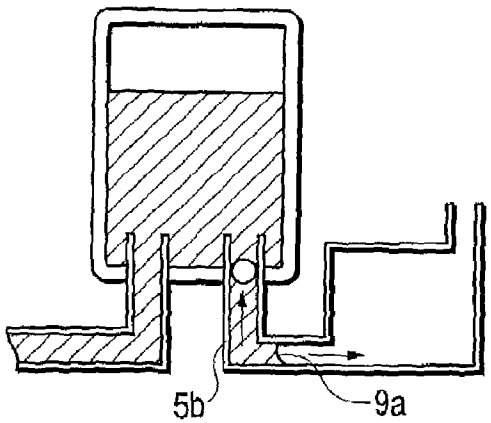

As the ink in the main tank 4 is consumed, the front end 9*a* of the ink gradually moves toward the air introducing needle 5*b* as shown in FIG. 4B, and, upon reaching a position directly below the air introducing needle 5*b*, the air floats as a bubble in the air introducing needle 5*b* as shown in FIG. 4C and is introduced into the main tank 4. In return, the ink in the main tank 4 enters the interior of the air introducing needle 5*b*, whereby the front end 9*a* of the ink returns to the original state shown in FIG. 4A.

Figure 4D:
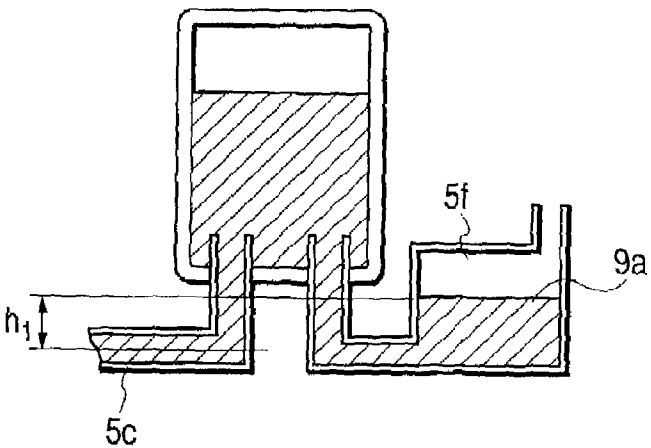

FIG. 4D shows a state where ink is accumulated in the buffer chamber 5*f*. In this state, the front end 9*a* of the ink is at a position in the middle of the height of the buffer chamber 5*f* and higher than the liquid path 5*c* by h1 (mm) so that the pressure in the liquid path 5*c* is −h1 (mmAq).

Figure 5:
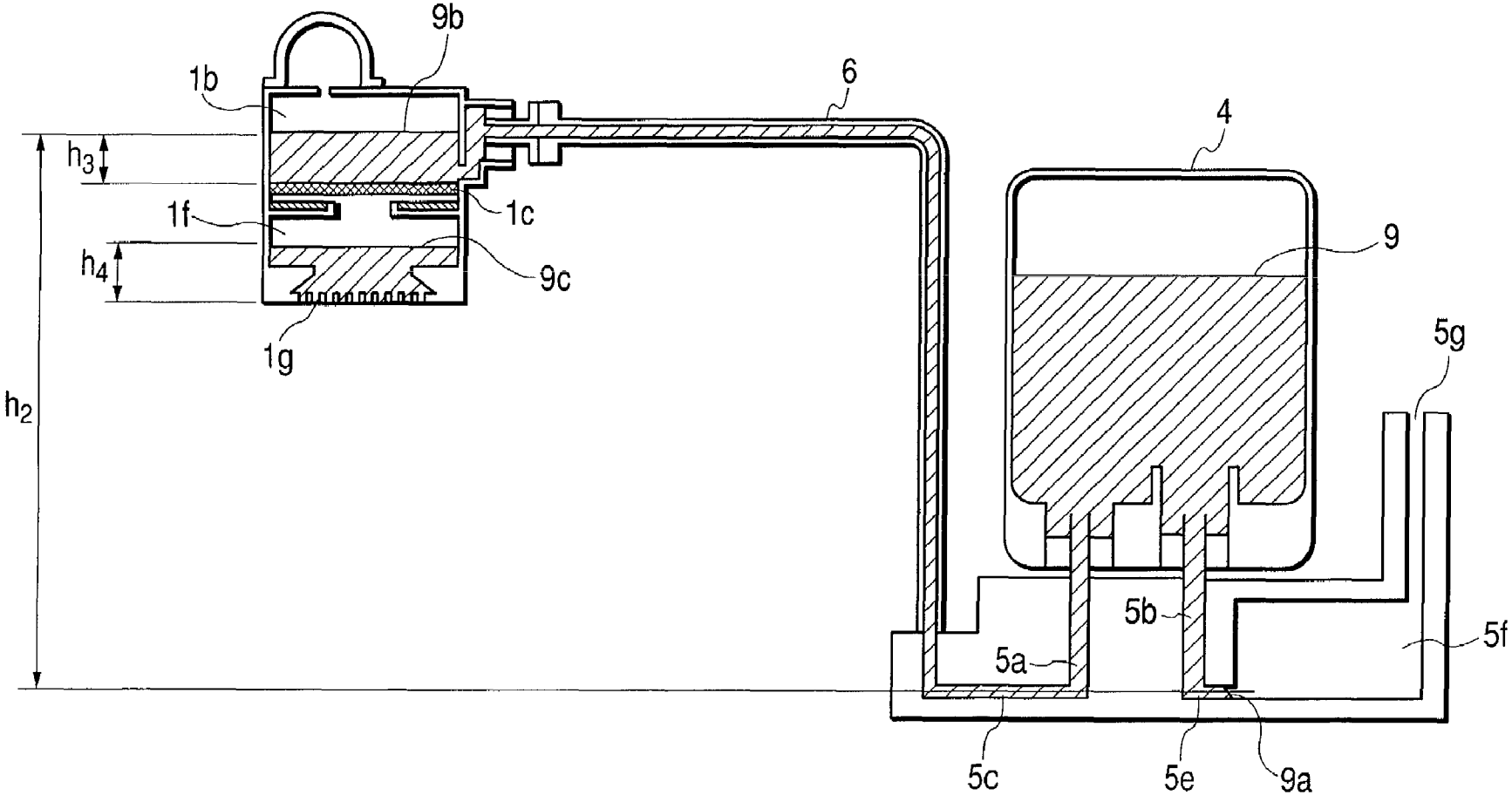
FIG. 5 is a view showing the pressure on the nozzle by the water head in the ink supply path shown in FIG. 3.
Figure 6:
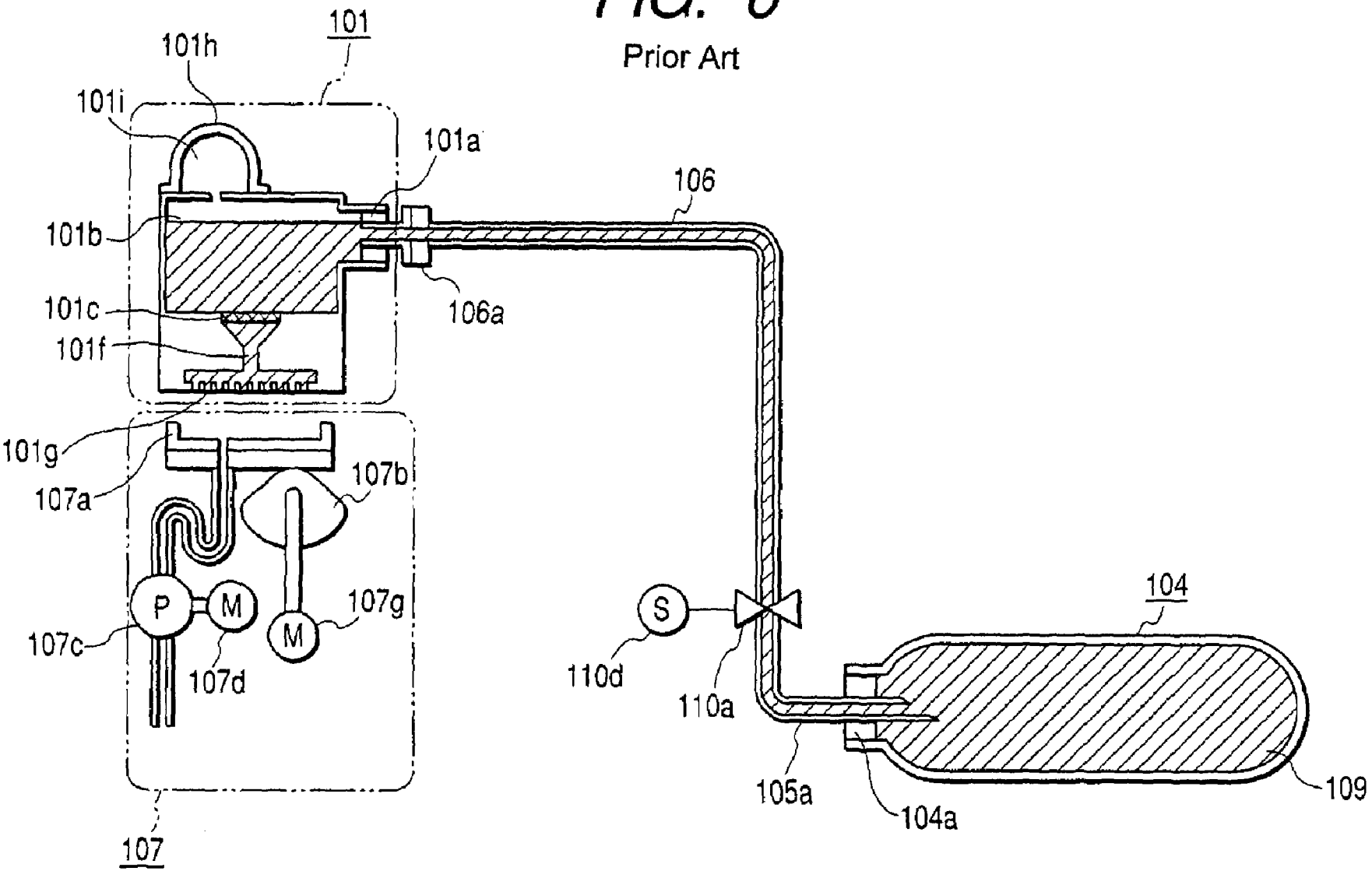
FIG. 6 Prior Art
FIG. 6 is a view showing an ink supply system in an ink jet recording apparatus of tube supply system representing a background technology.

Thus, in the present embodiment, the negative pressure Pn applied to the lower end of the nozzle 1*g* (cf. FIG. 3) by the water head is Pn~−9.8×(h2−h3−h4)Pa in the normal state or −9.8×(h2−h1−h3−h4)Pa in a state where the ink is accumulated in the buffer chamber 5*f*, wherein h2 (mm) is the height from the liquid path 5*c* to the upper face 9*b* in the sub tank 1*b* as shown in FIG. 5, h3 (mm) is the height from the filter 1*c* to the upper surface 9*b* of the ink in the sub tank 1*b* and h4 (mm) is the height from the lower end of the nozzle 1*g* to the upper surface 9*c* of the ink in the liquid chamber 1*f*. The value Pn is so selected as to be contained within the aforementioned negative pressure range of (−4.053 to −2.0265 kPa).

Again referring to FIG. 3, the ink supply needle 5*a* and the air introducing needle 5*b* are connected to a circuit 5*h* for measuring the electrical resistance of the ink, thereby detecting the presence or absence of ink in the main tank 4. The circuit 5*h* detects an electrically closed state in the presence of ink in the main tank 4 since a current flows in the circuit 5*h* through the ink in the main tank 4, but an electrically open state in the absence of ink or in case the main tank 4 is not mounted. Since the detected current is very weak, the insulation between the ink supply needle 5*a* and the air introducing needle 5*b* is important. In the present embodiment, the path from the ink supply needle 5*a* to the recording head 1 is made completely independent from the path from the air introducing needle 5*b* to the air communicating aperture 5*g*, whereby it is rendered possible to measure the electrical resistance of the ink only in the main tank 4.

In the following there will be given an explanation on the recovery unit 7. The recovery unit 7 serves to suck ink and air from the nozzle 1*g* and to operate the shut-off valve 10, and is provided with a suction cap 7*a* for capping the ink discharge face (containing the aperture of the nozzle 1*g*) of the recording head 1, and a link 7*e* for operating the lever 10*d* of the shut-off valve 10.

The suction cap 7*a* is comprised of an elastic member made of a material such as rubber, at least in a portion coming into contact with the ink discharge face, and is rendered movable between a position for tightly closing the ink discharge face and a position retracted from the recording head 1. The suction cap 7*a* is connected to a suction pump 7*c*, which is driven by a pump motor 7*d* to execute suction through the suction cap 7*a*. The suction pump 7*c* is comprised of a tube pump having plural rollers capable of continuous suction and varying the suction amount by changing the revolution of the pump motor 7*d*. The present embodiment employs a suction pump 7*c* capable of reducing pressure to −0.4 atm (40.53 kPa).

A link 7*e* slides by a cam 7*f* to actuate the lever 10*d* of the shut-off valve 10, thereby opening or closing the same. Cams 7*b*, 7*f* are positioned coaxially and can rotate in a direction indicated by an arrow by a cam control motor 7*g*. The timing of the cam 7*b* coming into contact with the suction cap 7*a* in the positions a to c corresponds to the timing of the cam 7*f* coming into contact with the link 7*e* in the positions a to c. In the position a, the cam 7*b* separates the suction cap 7*a* from the ink discharge face of the recording head 1, and the cam 7*f* presses the link 7*e* to elevate the lever 10*d*, thereby opening the valve 10. In the position b, the cam 7*g* brings the suction cap 7*a* in contact with the ink discharge face, and the cam 7*f* pulls back the link 7*e* to close the valve. In the position c, the cam 7*b* brings the suction cap 7*a* in contact with the ink discharge face, and the cam 7*f* presses the link 7*e* to open the valve.

In the recording operation, the cams 7*b*, 7*f* are maintained in a state of the position a to enable ink discharge from the nozzle 1*g* and ink supply from the main tank 4 to the recording head 1. In a non-operating state including a stand-by state and a pause, the cams 7*b*, 7*f* are maintained in a state of the position b to cover the nozzle face of the recording head 1 by the suction cap 7*a*, thereby preventing drying of the nozzle 1*g* and preventing ink flow-out from the recording head 1 (particularly in case the apparatus itself is moved, the apparatus may be inclined to induce ink flow-out). The position c of the cams 7*b*, 7*f* is employed in an ink filling operation to the recording head 1 (to be explained later).

In the foregoing there has been explained the ink supply path from the main tank 4 to the recording head 1, but the configuration shown in FIG. 3 eventually results in air accumulation in the recording head 1 over a prolonged period.

In the sub tank 1*b*, there are accumulated air permeating through the ink supply tube 6 and the elastic members 1*h*, and air dissolved in the ink. The air permeating through the ink supply tube 6 and the elastic member 1*h* can be prevented by employing a material of high gas barrier property, but such material is expensive. In the mass produced consumer equipment, it is not easy to use a high-performance material in consideration of the cost. In the present embodiment, the ink supply tube 6 is composed of a polyethylene tube of low cost and high flexibility, and the elastic member 1*h* is composed of butyl rubber.

On the other hand, in the liquid chamber 1*f*, there is gradually accumulated air because of a phenomenon that the bubble generated at the ink discharge from the nozzle 1*g* causes fissure and returns to the liquid chamber 1*f*, or a phenomenon that the fine bubbles present in the ink gather to form a larger bubble by an increase of the ink temperature in the nozzle 1*g*.

According to the experiment of the present inventors, in the configuration of the present embodiment, the air accumulates by about 1 ml/month in the sub tank 1*b* and about 0.5 ml/month in the liquid chamber 1*f*.

The air accumulation in the sub tank 1*b* and the liquid chamber 1*f*, if large, reduces the ink amounts therein. In the sub tank 1*b*, an ink deficiency causes exposure of the filter 1*c* to the air to reduce the effective area thereof, thereby increasing the pressure loss thereof and eventually disabling ink supply to the liquid chamber 1*f*. Also an ink deficiency in the liquid chamber 1*f* causes exposure of the upper end of the nozzle 1*g* to the air, thereby rendering ink supply thereto difficult. In this manner, a fatal situation arises unless each of the sub tank 1*b* and the liquid chamber 1*f* contains ink at least equal to a predetermined amount.

Therefore, by filling each of the sub tank 1*b* and the liquid chamber 1*f* with an appropriate amount of ink at a predetermined interval, the ink discharging performance can be stably maintained over a long period, even without employing the material of high gas barrier property. For example, in the present embodiment, the sub tank 1*b* and the liquid chamber 1*f* may be filled with ink every month by an amount equal to the accumulating air amount per month plus fluctuation in the filling.

The ink filling into the sub tank 1*b* and the liquid chamber 1*f* is executed utilizing the suction operation by the recovery unit 7. More specifically, the suction pump 7*c* is activated in a state where the ink discharge face of the recording head 1 is tightly closed by the suction cap 7*a*, thereby sucking the ink in the recording head 1 from the nozzle 1*g*. However, in simple ink suction from the nozzle 1*g*, ink of an amount approximately equal to the ink sucked from the nozzle 1*g* flows from the sub tank 1*b* into the liquid chamber 1*f* and ink of an amount approximately equal to that flowing out of the sub tank 1*b* flows from the main tank 4 into the sub tank 1*b*, so that the situation does not change much from the state prior to suction and the filling of ink of the appropriate amount cannot be achieved.

Therefore, in the present embodiment, in order to fill the sub tank 1*b* and the liquid chamber 1*f* separated by the filter 1*c* respectively with appropriate amounts of ink, the sub tank 1*b* and the liquid chamber 1*f* are reduced to a predetermined pressure utilizing the shut-off valve 10, thereby setting the volumes of the sub tank 1*b* and the liquid chamber 1*f*.

In the following there will be explained the ink filling operation of the sub tank 1*b* and the liquid chamber 1*f*, and the volume setting thereof.

In the ink filling operation, at first the carriage 2 (cf. FIG. 1) is moved to a position where the recording head 1 is opposed to the suction cap 7*a*, and the cam control motor 7*g* of the recovery unit 7 is activated to rotate the cams 7*b*, 7*f* to a state where the position b is in respective contact with the suction cap 7*a* and the link 7*e*. Thus, the ink discharge face of the recording head 1 is closed by the suction cap 7*a*, and the shut-off valve 10 closes the ink path from the main tank 4 to the recording head 1.

The pump motor 7*d* is activated in this state to execute suction by the suction pump 7*c* from the suction cap 7*a*. This suction operation sucks ink and air, remaining in the recording head 1, through the nozzle 1*g*, thereby reducing the pressure in the recording head 1. The suction pump 7*c* is stopped when the suction reaches a predetermined amount, and the cam control motor 7*g* is activated to rotate the cams 7*b*, 7*f* to a state where the position c is in contact with the suction cap 7*a* and the link 7*e*. Thus, the ink discharge face remains in the closed state by the suction cap 7*a* but the shut-off valve 10 is opened. The suction amount of the suction pump 7*c* is so selected as to bring the interior of the recording head 1 to a predetermined pressure, and can be determined by calculation or by experiment.

As the internal pressure of the recording head 1 is reduced, ink flows into the recording head 1 through the ink supply tube 6, thereby filling each of the sub tank 1*b* and the liquid chamber 1*f* with ink. The amount of ink filling corresponds to a volume required for returning the sub tank 1*b* and the liquid chamber 1*f* to the atmospheric pressure, and is determined by the volume and pressure thereof.

The ink filling into the sub tank 1*b* and the liquid chamber 1*f* is completed in about 1 second after the opening of the shut-off valve 10. Upon completion of the ink filling, the cam control motor 7*g* is driven to rotate the cams 7*g*, 7*f* to a state where the position b is in contact with the suction cap 7*a* and the link 7*e*. In this manner the suction cap 7*a* is separated from the recording head 1, and the suction pump 7*c* is activated again to suck the ink remaining in the suction cap 7*a*. As the shut-off valve 10 is open in this state, the recording head 1 is in a state capable of discharging ink to form a character or an image on the recording sheet S (cf. FIG. 1). In a stand-by state or in a pause state, the cam control motor 7*g* is activated again to rotate the cams 7*b*, 7*f* to a state where the position b is in contact with the suction cap 7*a* and the link 7*e*, thereby closing the ink discharge face of the recording head 1 with the suction cap 7*a* and closing the shut-off valve 10.

Unless the ink in the sub tank 1*b* and the liquid chamber 1*f* becomes deficient over a long period, it is not necessary to frequently execute the suction operation by the recovery unit 7, so that the chances of wasting ink can be reduced. Also the ink filling, if required in both of the sub tank 1*b* and the liquid chamber 1*f*, can be achieved in a single filling operation, thereby allowing to economize the ink.

In the following there will be given an explanation on the aforementioned filling operation and volume setting.

Now, let us consider the relationship among the volume V1 of the sub tank 1*b*, the ink amount S1 to be filled therein and the pressure P1 (relative to the atmospheric pressure) therein. Based on the law "PV=constant", the sub tank 1*b* can be filled with the ink of an appropriate amount in the filling operation, by setting a relation $V1=S1/|P1|$. Similarly, for the volume V2 of the liquid chamber 1*f*, the ink amount S2 to be filled therein and the pressure P2 (relative to the atmospheric pressure) therein, the liquid chamber 1*f* can be filled with the ink of an appropriate amount in the filling operation, by setting a relation $V2=S2/|P2|$.

Also the filter 1*c* separating the sub tank 1*b* and the liquid chamber 1*f* has a fine mesh structure and the air flow therein is difficult in a state having a meniscus therein, as explained in the foregoing. For a pressure Pm required for air permeation through the filter 1*c* having such meniscus, in case of suction from the nozzle 1*g* by the recovery unit 7, the pressure P2 in the liquid chamber 1*f* becomes lower by Pm than the pressure P1 in the sub tank 1*b* since the air has to come from the sub tank 1*f* through the filter 1*c*. Thus, by employing this relationship in determining the volumes of the sub tank 1*b* and the liquid chamber 1*f*, the condition of the filling operation can be easily determined.

In the following there will be explained specific examples of the aforementioned filling operation and the volume setting. In the present embodiment it is assumed that the ink filling is executed every month, and the air accumulating amount per month is 1 ml in the sub tank 1*b* and 0.5 ml in the liquid chamber 1*f*. It is also assumed that the ink amount required in the sub tank 1*b* so as not to expose the filter 1*c* to air is 0.5 ml while the ink amount required in the liquid chamber 1*f* so as not to expose the nozzle 1*g* to air is 0.5 ml, and the fluctuation in the ink filling amount is 0.2 ml both in the sub tank 1*b* and the liquid chamber 1*f*. These values are determined experimentally. Thus, the ink amount to remain after the filling operation is the sum of these amounts, and is as large as 1.7 ml in the sub tank 1*b* and 1.2 ml in the liquid chamber 1*f*.

The reduced pressure in the recording head 1 is selected within the ability of the recovery unit 7. In the present embodiment, since the power limit of the suction pump 7*c* is −0.6 atm (−60.795 kPa), the suction amount of the suction pump 7*c* is experimentally so determined that the pressure in the suction cap 7*a* can reach −0.5 atm (−50.6625 kPa) with a certain margin, and is controlled by the revolution of the pump motor 7*d*.

As the pressure required for air permeation against the meniscus in the nozzle 1*g* is experimentally −0.05 atm (−5.06625 kPa), there is generated a difference between the pressures of the suction cap 7*a* and the liquid chamber 1*f* by the resistance of the nozzle 1*g*, whereby the pressure in the liquid chamber 1*f* becomes higher than that in the suction cap 7*a* by 0.05 atm (5.06615 kPa). Similarly, as the pressure required for air permeation against the meniscus in the filter 1*c* is experimentally −0.1 atm (−10.1325 kPa), there is generated a difference between the pressures of the liquid chamber 1*f* and the sub tank 1*b* by the resistance of the filter 1*c*, whereby the pressure in the sub tank 1*b* becomes higher than that in the liquid chamber 1*f* by 0.1 atm (10.1325 kPa). Therefore, by setting the pressure in the suction cap 7*a* at −0.5 atm (−50.6625 kPa), the pressure in the liquid chamber 1*f* becomes −0.45 atm (−45.5963 kPa) while that in the sub tank 1*b* becomes −0.35 atm (−35.4638 kPa).

In order to fill the sub tank 1*b* with ink of 1.7 ml, the volume V1 thereof is so selected that the internal pressure becomes −0.35 atm (−35.4638 kPa) when ink of 1.7 ml is sucked from the sub tank 1*b* having an internal pressure of about 1 atm (101.325 kPa). Thus, V1=1.7/0.35=4.85 ml. Similarly the volume V2 of the liquid chamber 1*f* can be determined as V2=1.2/0.45=2.67 ml.

After the internal pressure of the recording head 1 is reduced under the foregoing conditions, the shut-off valve 10 is opened, whereby the ink flows into the recording head 1 in a reduced pressure state. More specifically, at first the ink flows into the sub tank 1*b* whereby the air inflated to the volume V1 under reduced pressure is restored almost to the atmospheric pressure. The air volume Via in the sub tank 1*b* in such state is given by V1*a*=V1×(1−0.35)=3.15 ml, and the filling is terminated when ink in an amount of V1−V1*a*=1.7 ml is filled into the sub tank 1*b*. Similarly, in the liquid chamber 1*f*, the ink flows from the sub tank 1*b* whereby the air inflated to the volume V2 under reduced pressure is restored almost to the atmospheric pressure. The air volume V2*a* in the liquid chamber 1*f* in such state is given by V2*a*=V2×(1−0.45)=1.47 ml, and the filling is terminated when ink in an amount of V2−V2*a*=1.2 ml is filled into the liquid chamber 1*f*.

Thus, by setting the volumes and reduced pressures of the sub tank 1*b* and the liquid chamber 1*f* in the above-described manner, it is rendered possible to fill the sub tank 1*b* and the liquid chamber 1*f*, separated by the filter 1*c*, with the ink of appropriate amounts in a single filling operation, so that the recording head can be properly operated over a long period even in a situation where air is accumulated therein.

Also against the drawback that the bubble clogs the flow path between the filter and the nozzle, the cross-sectional area of the liquid chamber 1*f* in the present embodiment is selected sufficiently large with respect to the diameter of the bubble that can exist in the liquid chamber 1*f*, so that the ink flow cannot be hindered by the bubble in the liquid chamber 1*f*. Furthermore, against the drawback that the bubble in the liquid chamber enters the nozzle or clogs the connection between the liquid chamber and the nozzle, the cross-sectional area of the liquid chamber 1*f* is selected sufficiently large as explained in the foregoing, so that the bubble generated in the liquid chamber 1*f* rises by the floating force thereof in the ink and is united with the air layer, thereby being prevented from entering the nozzle 1*g*. Thus, by constructing the liquid chamber 1*f* separated from the sub tank 1*b* by the filter 1*c* in the above-described manner, it is rendered possible to significantly improve the reliability against the discharge failure resulting from the bubble generation in the liquid chamber 1*f* or from the movement of the generated bubble.

Also in case of constructing either of the sub tank and the liquid chamber in the configuration of the present embodiment and the other according to the background technology, there can be achieved the aforementioned function at least on the former and there can be obtained an advantage of achieving efficient air elimination.

In the foregoing description, it is assumed that the ink remains, even in a small amount, in the sub tank 1*b* and the liquid chamber 1*f* after the suction operation and that the sum of the remaining ink amount and the ink filling amount becomes appropriate, namely "ink amount to be present"="remaining ink amount"+"ink filling amount". However, in case the ink in the sub tank 1*b* or in the liquid chamber 1*f* is completely discharged by the suction operation, the ink amount to be present in the sub tank 1*b* or in the liquid chamber 1*f* coincides with the ink filling amount, so that nk amount to be present can be considered equal to "ink filling amount".

What is claimed is:

1. An ink jet recording apparatus comprising:

a recording head for discharging ink from a nozzle;

suction means comprising a single negative pressure pump for forcibly expelling ink in said recording head from said nozzle; and ink supply means for supplying ink to said recording head by using only said suction means comprising the single negative pressure pump, wherein said recording head comprises a first liquid chamber upstream relative to an ink flow direction and a second liquid chamber downstream relative to the ink flow direction and said first and second liquid chambers are capable of accumulating air therein, wherein a filter is provided between said first and second liquid chambers to separate the liquid chambers and said filter has a mesh configuration with a plurality of holes having a meniscus strength, wherein at least one of said first and second liquid chambers has a volume determined by a suction force of said suction means and a desired ink amount to be present after suction by said suction means, wherein said ink supply means comprises an ink tank for containing ink, an ink supply tube communicating with said recording head and a shut-off valve for opening and closing said ink supply tube, wherein said suction means further comprises a suction cap for closing said recording head and said single negative pressure pump effects suction through said suction cap, and wherein upon filling said recording head with ink from said ink supply means by said suction means, said shut-off valve is closed and as a pressure of said second liquid chamber is reduced to a predetermined pressure by said suction means, a pressure of said first liquid chamber differs from the predetermined pressure by the meniscus strength of said filter, and then said shut-off valve is opened to release the pressure reduction so that said first and second liquid chambers are filled through said ink supply tube with the ink in said ink tank by different amounts, respectively, with one cycle, the ink being capable of being filled in the one cycle.

2. An ink jet recording apparatus according to claim 1, wherein an amount of ink filled by one filling operation is a volume necessary for said first and second liquid chambers subjected to pressure reduction to return to atmospheric pressure.

* * * * *

UNITED STATES PATENT AND TRADEMARK OFFICE

CERTIFICATE OF CORRECTION

PATENT NO. : 7,150,519 B2
APPLICATION NO. : 10/078457
DATED : December 19, 2006
INVENTOR(S) : Kono et al.

It is certified that error appears in the above-identified patent and that said Letters Patent is hereby corrected as shown below:

COLUMN 2:
Line 64, “following” should read --following,--.

COLUMN 3:
Line 8, “following” should read --following,--.

COLUMN 7:
Line 25, “following” should read --following,--.
Line 49, “following” should read --following,--.

COLUMN 9:
Line 40, “quently” should read --quently,--.

COLUMN 10:
Line 1, “following” should read --following,--.

COLUMN 12:
Line 13, “following” should read --following,--.

COLUMN 13:
Line 28, “Also” should read --Also,--.
Line 63, “following” should read --following,--.

COLUMN 14:
Line 53, “following” should read --following,--.
Line 66, “Also” should read --Also,--.

UNITED STATES PATENT AND TRADEMARK OFFICE

CERTIFICATE OF CORRECTION

PATENT NO. : 7,150,519 B2
APPLICATION NO. : 10/078457
DATED : December 19, 2006
INVENTOR(S) : Kono et al.

It is certified that error appears in the above-identified patent and that said Letters Patent is hereby corrected as shown below:

COLUMN 15:
Line 11, "following" should read --following,--.
Line 64, "Via" should read --Vla--.

COLUMN 16:
Line 35, "Also" should read --Also,--.
Line 51, "nk" should read --ink--.

Signed and Sealed this

Twenty-sixth Day of August, 2008

JON W. DUDAS
*Director of the United States Patent and Trademark Office*